US009499295B2

(12) United States Patent
Saslekov

(10) Patent No.: US 9,499,295 B2
(45) Date of Patent: Nov. 22, 2016

(54) ECO-FRIENDLY LIQUID CONTAINER

(71) Applicant: Todor E. Saslekov, Sofia (BG)

(72) Inventor: Todor E. Saslekov, Sofia (BG)

( * ) Notice: Subject to any disclaimer, the term of this patent is extended or adjusted under 35 U.S.C. 154(b) by 3 days.

(21) Appl. No.: 14/951,838

(22) Filed: Nov. 25, 2015

(65) Prior Publication Data

US 2016/0075469 A1 Mar. 17, 2016

Related U.S. Application Data

(63) Continuation of application No. 14/062,760, filed on Oct. 24, 2013.

(60) Provisional application No. 61/718,186, filed on Oct. 24, 2012.

(51) Int. Cl.
*B65D 73/00* (2006.01)
*B65D 5/60* (2006.01)
(Continued)

(52) U.S. Cl.
CPC . *B65D 5/60* (2013.01); *B65B 7/28* (2013.01); *B65B 53/02* (2013.01); *B65D 25/16* (2013.01); *B65D 43/02* (2013.01); *B65D 71/08* (2013.01); *B65D 75/004* (2013.01); *B65D 75/525* (2013.01); *B65D 77/068* (2013.01); *B65D 77/28* (2013.01); *B65D 85/72* (2013.01)

(58) Field of Classification Search
CPC ..... B65D 5/60; B65D 25/16; B65D 43/02; B65D 71/08; B65D 77/068; B65D 77/28; B65D 85/72; B65D 75/004; B65D 75/525; B65B 7/28; B65B 53/02
USPC ..... 220/495.03; 229/117.27, 109, 122.3, 229/122.31; 206/524.8; 426/106
See application file for complete search history.

(56) References Cited

U.S. PATENT DOCUMENTS 6,076,968 A 6/2000 Smith et al.
6,270,255 B1 8/2001 Kaufman et al.
(Continued)

FOREIGN PATENT DOCUMENTS

GB 2172261 * 9/1986 ..... B65D 77/06
GB 2172261 A 9/1986

OTHER PUBLICATIONS

International Search Report and Written Opinion for International Application No. PCT/US2014/062135, Applicant, Saslekov, Todor.

*Primary Examiner* — Fenn Mathew
*Assistant Examiner* — Elizabeth Volz
(74) *Attorney, Agent, or Firm* — Richards Patent Law P.C.

(57) ABSTRACT

The present disclosure provides an environmentally friendly container for liquids that is designed to use few materials and, upon disassembly, may easily be separated into recyclable elements. The container includes a housing, a flexible storage bag within the housing, and a lid positioned over an end of the housing, wherein the flexible storage bag is held between the lid and the housing. Further, the container includes a shrink-wrap film surrounding at least a portion of the housing and lid, wherein the shrink-wrap film secures the lid to the housing.

11 Claims, 9 Drawing Sheets

(51) Int. Cl.

| | |
|---|---|
| ***B65B 53/02*** | (2006.01) |
| ***B65D 25/16*** | (2006.01) |
| ***B65D 75/00*** | (2006.01) |
| ***B65D 75/52*** | (2006.01) |
| ***B65D 77/06*** | (2006.01) |
| ***B65D 77/28*** | (2006.01) |
| ***B65B 7/28*** | (2006.01) |
| ***B65D 43/02*** | (2006.01) |
| ***B65D 71/08*** | (2006.01) |
| ***B65D 85/72*** | (2006.01) |

(56) References Cited

U.S. PATENT DOCUMENTS

| | | | | |
|---|---|---|---|---|
| 2009/0080813 | A1* | 3/2009 | Rasmussen | B65D 75/008 383/205 |
| 2010/0308053 | A1* | 12/2010 | Wisecarver | B65D 5/10 220/315 |
| 2012/0055818 | A1* | 3/2012 | Zimmern | A47G 19/2205 206/222 |
| 2012/0145571 | A1 | 6/2012 | Feldmann | |
| 2012/0255928 | A1* | 10/2012 | Greenberg | A47G 19/2222 215/392 |

* cited by examiner

ECO-FRIENDLY LIQUID CONTAINER

CROSS-REFERENCE TO RELATED APPLICATIONS

This application is a divisional application of, and claims the benefit of priority to, U.S. patent application Ser. No. 14/062,760 filed on Oct. 14, 2013, which claims priority to U.S. Provisional Patent Application No. 61/718,186 filed on Oct. 24, 2012, each of which is incorporated by reference in its entirety.

BACKGROUND OF THE INVENTION

The present subject matter relates generally to eco-friendly liquid packaging containers.

Currently, the world uses approximately 200,000,000,000 plastic bottles and roughly the same number of aseptic package containers a year. Worldwide, on average, only 15% of the plastic bottles are recycled. Further, recycled bottles in the USA account for only 20-29% of the total recycled material according to the American Plastics Council. The non-recycled bottles end in landfills or as uncollected litter.

For every one ton of plastic that is recycled or reduced, roughly 2 tons of carbon dioxide emissions are saved. One ton of recycled plastic saves 5,774 kilowatts of electricity and 685 gallons of oil according to the U.S. House Select Committee on Energy Independence and Global Warming. In addition, replacing 3,700 polyethylene terephthalate (PET) bottles, a popular plastic used in bottles, saves one barrel of petrol.

Notwithstanding attempts to reduce the amount of plastic used in plastic bottles, the average 16 ounce (oz.) plastic bottle weighs approximately 16 grams. The lightest available 16 oz. plastic bottle weighs approximately 9.2 grams. However, such a light plastic bottle requires expensive equipment to produce.

Accordingly, there is a need for a new product that is a sustainable and eco-friendly solution that helps lessen the environmental impact of packaging beverages. In addition, there is a need for a product that decreases the greenhouse effect, reduces the need for more landfill space, and uses mostly renewable materials. The product needs to be easily mass-produced, require a small investment and production space, have a production that may be scalable, and a competitive price with the standard plastic bottles and other liquid container packages.

BRIEF SUMMARY OF THE INVENTION

The present disclosure provides an eco-friendly liquid container for non-carbonated liquids. Various examples of the container are provided herein.

The disclosed liquid container is made predominantly from a paper housing, a thin plastic lid, and a single layer of shrink-wrap film, thereby resulting in a container that uses up to 70% less plastic and non-recyclable materials than conventional plastic bottles. In addition to being environmentally friendly, the reduction in materials is also cost effective and results in a product that weighs less than conventional beverage containers. In one example, the liquid container only uses 5.5 grams of plastic.

The present disclosure provides a container comprising a housing including a side wall, a housing first end, and a housing second end. The container also contains a flexible storage bag within the housing, and a lid positioned over the housing first end, wherein at least a portion of the flexible storage bag is held between the lid and the housing first end. In addition, the container includes a shrink-wrap film surrounding at least a portion of the housing and at least a portion of the lid, wherein the shrink-wrap film secures the lid to the housing.

The container may further include at least one tab extending from the housing second end, wherein the at least one tab defines a bottom plane perpendicular to the side wall. The shrink-wrap film may surround at least a portion of the at least one tab, wherein the at least one tab and the shrink-wrap film retain the bottom panel within the housing along the bottom plane.

The housing may be formed from a single sheet of paper. In an example, the housing is made of a foldable cardboard. In addition, the cross-sectional shape of the housing may be an octagon.

In an example, at least two portions of the flexible storage bag are secured between the lid and the housing first end. The flexible storage bag may be made of a polymeric material. Further, the lid may include an opening providing access to the flexible storage bag.

The container may also include a straw releasably connected to an outer surface of the shrink-wrap film or the housing, wherein the straw is configured to puncture through the shrink-wrap film and the flexible storage bag In an example, the container may include a liquid within the flexible storage bag, wherein the amount of liquid is less than the storage capacity of the flexible storage bag.

The present disclosure also provides a method of forming a container, wherein the method comprises forming a housing including a side wall, a housing first end, and a housing second end, and inserting a flexible storage bag into the housing. The method also includes placing a lid over the housing first end wherein the lid secures at least a portion of the flexible storage bag between the housing first end and the lid, and securing the lid to the housing by heat sealing a shrink-wrap film around at least a portion of the housing and at least a portion of the lid.

The container may further include at least one tab extending from the housing second end, wherein the at least one tab defines a bottom plane perpendicular to the side wall. The shrink-wrap film may surround at least a portion of the at least one tab, wherein the at least one tab and the shrink-wrap film retain the bottom panel within the housing along the bottom plane.

The housing may be formed by folding a single sheet of paper. In an example, the housing is made of a foldable cardboard. Further, the cross-sectional shape of the housing may be an octagon.

The flexible storage bag may be made of a polymeric material. In an example, at least two portions of the flexible storage bag are secured between the lid and the housing first end. Further, the flexible storage bag may include a liquid, wherein the amount of liquid is less than the storage capacity of the flexible storage bag.

In an example, the lid includes an opening providing access to the flexible storage bag. The method may include releasably attaching a straw to an outer surface of the heat sealed shrink-wrap film, wherein the straw is configured to puncture through the shrink-wrap film and the flexible storage bag.

An advantage of the present container and method decreasing the environmental impact of packaging liquids.

A further advantage of the present container and method is reducing greenhouse emissions and landfill space compared to conventional plastic bottles.

Another advantage of the present container and method is providing a cost effective manufacturing process for packaged liquids.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The present disclosure provides an eco-friendly container 10 for liquids, wherein the container components, including the size and shape of the components, are intended to minimize the material and transportation cost for both the materials to make the containers 10 and the final container 10 product. The container 10 is intended for use with non-carbonated beverages. The container 10 disclosed herein uses up to 70% less plastic and non-recyclable materials than other environmentally friendly liquid containers. The container 10 also typically does not include permanent bonding or adhesives and, therefore, can be easily separated after the container is used in order to simplify the recycling process. As such, the container 10 may use the standard waste collection structures and can fully utilize existing recycling systems. Further, the examples provided herein comply with all applicable food related regulations.

Figure 1:
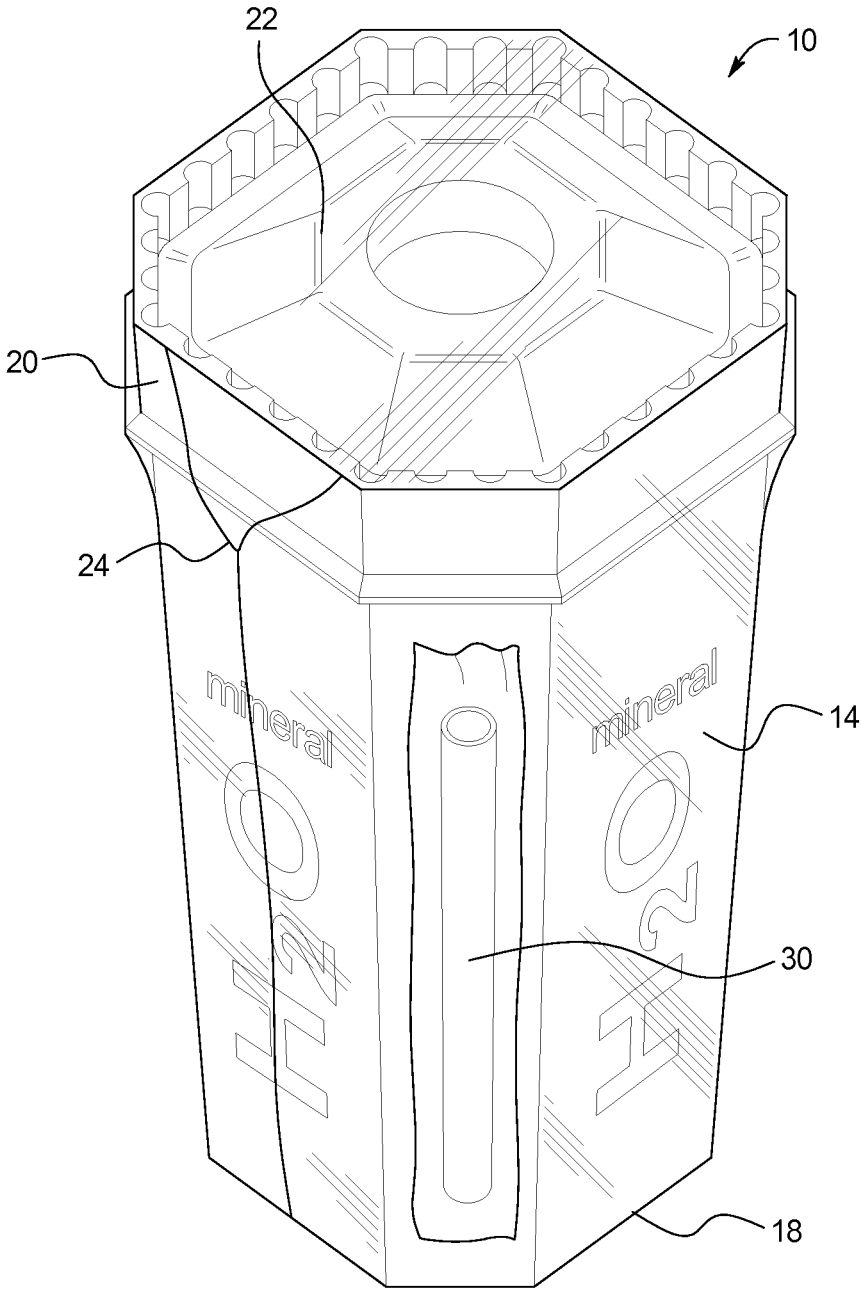
FIG. 1 is a perspective view of an embodiment of the container disclosed herein.

In an embodiment, the container 10 includes a housing 12 including a side wall 14, a housing first end 16, and a housing second end 18, as shown in FIG. 1. The housing 12 may be made of any suitable material, though the advantages provided herein are best accomplished using a recyclable and biodegradable product. For example, the housing 12 may be made of a foldable cardboard, sugarcane pulp, corn pulp, combinations thereof, or any other paper product. Alternatively, the housing 12 may be made from thin plastic, aluminum, etc.

The housing 12 may be formed by folding the housing material from a flat configuration into a three-dimensional shape. For example, the housing 12 may be formed by folding a single sheet of paper into a cylindrical shape or any of various cross-sectional shapes. For example, the housing 12 may be a circular, triangular, rectangular, hexagonal, octagonal or other cylinder. The three-dimensional housing 12 may be stabilized using a minimal amount of adhesive or, in certain circumstances, without adhesive. For example, the housing 12 may not require adhesive when the opposing forces of the filled flexible storage bag 20 and the shrink-wrap film 24 secure at least two ends of the housing 12 together, forming a three-dimensional shape. Alternatively, two ends of the housing material may include an adhesive, such that when the housing material is folded to connect two ends to form the three-dimensional structure, the adhesive maintains the connection between the two ends to assist in stabilizing the three-dimensional structure.

The cross-sectional shape of the housing 12 may be unvaried throughout the height of the housing 12. In other words, the cross-sectional area and shape of the housing first end 16 may be the same as that of the housing second end 18. Alternatively, the housing 12 may be tapered such that the cross-sectional area of the housing first end 16 may be larger or smaller than the cross-sectional area of the housing second end 18 (i.e., the housing 12 may be conical). In the examples shown in the figures, the housing 12 is cylindrical and the cross-sectional shape of the housing 12 is an octagon. However, it should be understood that any suitable shape may form the cross-sectional area of the housing 12, including, but not limited to, a triangle, square, rectangle, diamond, pentagon, hexagon, heptagon, and circle, among others.

Figure 2A:
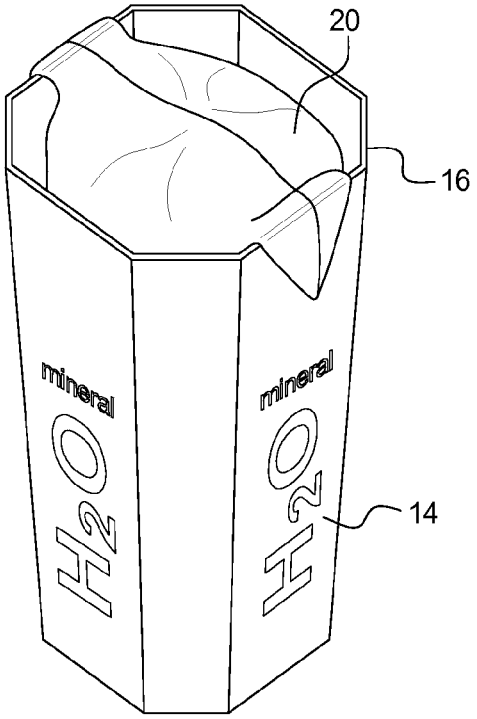
FIG. 2A is a perspective view of an example of the flexible storage bag positioned inside the housing with a portion of the flexible storage bag on the outer surface of the housing.

As mentioned above, the container 10 also enclose a flexible storage bag 20 within the housing 12, as shown in FIG. 2A. The flexible storage bag 20 may be made of any suitable material including, but not limited to, plastics or other polymeric materials, including various polymer blends, or combinations thereof. The flexible storage bag 20 may have a thickness and durability that allows the flexible storage bag 20 to store liquids without leaking, yet allows a straw to puncture the flexible storage bag 20.

As just mentioned, the container 10 may include a liquid stored within the flexible storage bag 20, wherein the amount of liquid may be equal or less than the storage capacity of the flexible storage bag 20. Typically, the amount of liquid occupies less than, and including, 95% of the total volume of the flexible storage bag 20. Alternatively, the amount of liquid may occupy less than, and including, 90%, less than and including 85%, or less than and including 80% of the total volume of the flexible storage bag 20. The flexible storage bag 20 may be any suitable size. For example, the flexible storage bag 20 may be capable of holding 8 ounces (oz.), 12 oz., 16 oz., 20 oz., or 24 oz., among other amounts. Similarly, the housing 12 may be various sizes and shapes. Further, it should be understood that the term "liquid" is meant to encompass various substances with varying viscosities, typically viscosities that may pass through a straw 30. For example, in this disclosure the term "liquid" includes, but is not limited to, water, non-carbonated drinks, sport drinks, energy drinks, smoothies, baby food, pureed food, soups, milk, milk shakes, coffee drinks, tea, juice, salad dressing, gravy, broth, and condiments, such as ketchup, mustard, mayonnaise, among others.

Figure 2B:
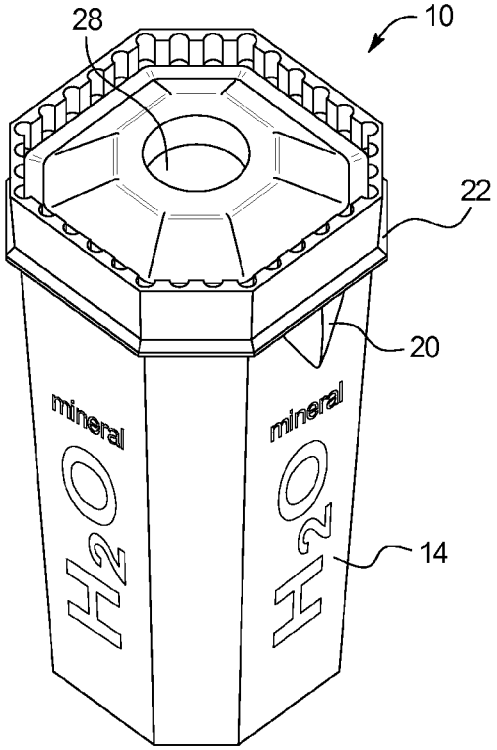
FIG. 2B is a perspective view of an example of the lid positioned over the housing first end, wherein a portion of the flexible storage bag is held between the lid and the housing first end.
Figure 2C:
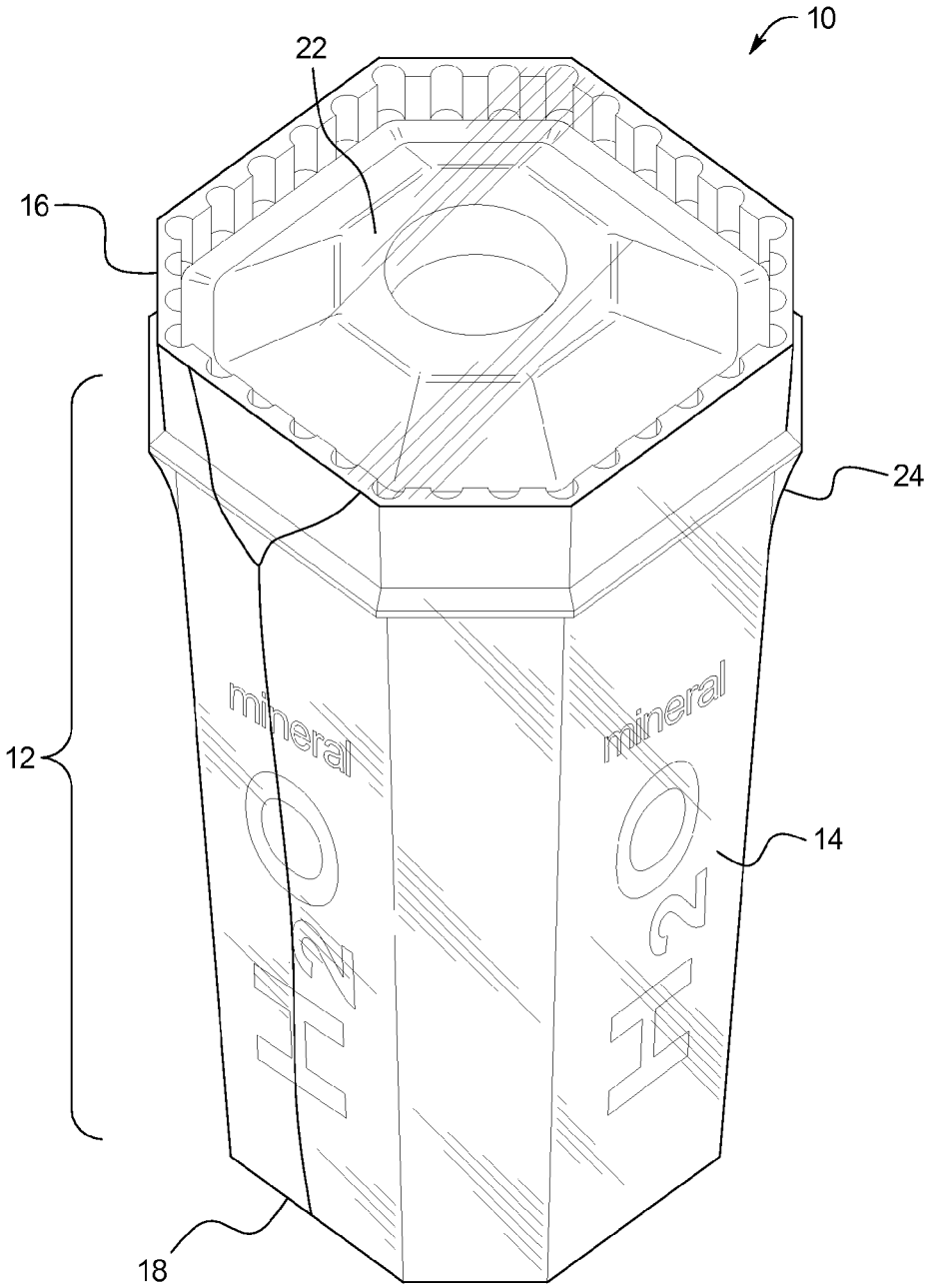
FIG. 2C is a perspective view of an embodiment of the container, wherein the shrink-wrap film secures the lid to the housing.
Figure 3:
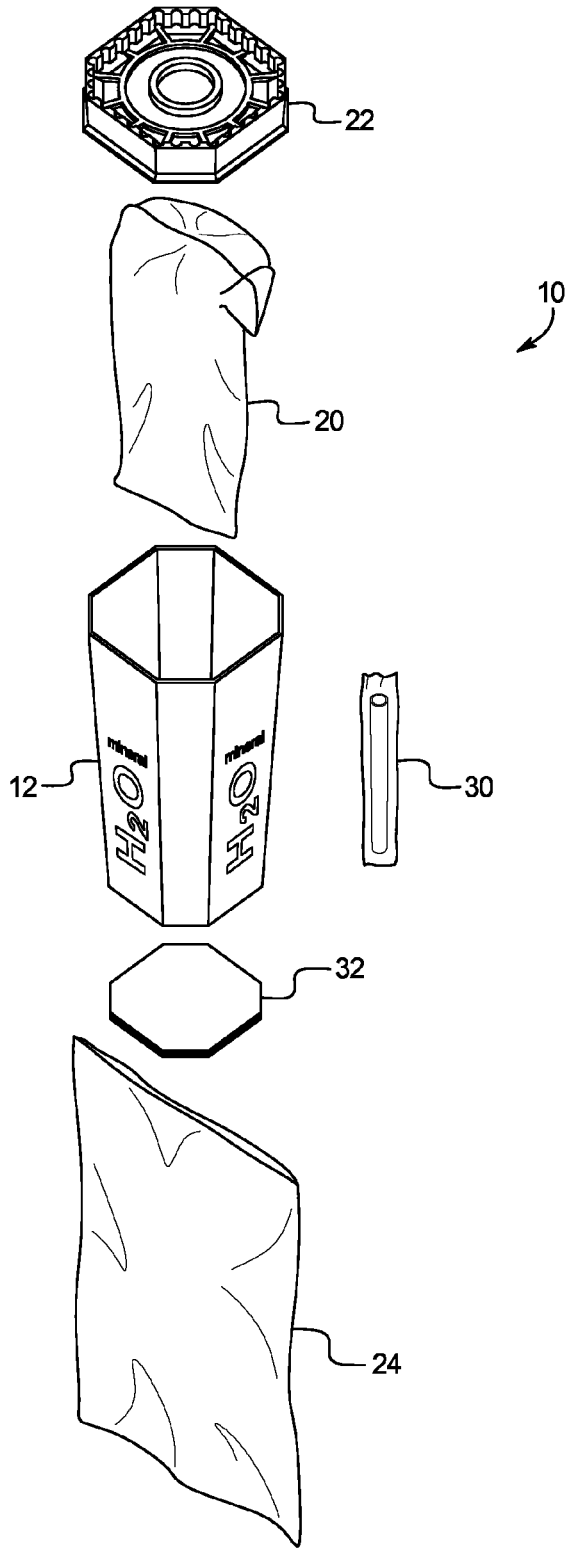
FIG. 3 is an exploded view of an example of the container.

The container 10 also includes a lid 22 positioned over the housing first end 16, wherein at least a portion of the flexible storage bag 20 is held between the lid 22 and the housing first end 16, as shown in FIG. 2B. In an example, at least two portions of the flexible storage bag 20 are secured between the lid 22 and the housing first end 16. The lid 22 may be made of any suitable material. Typically, the lid 22 is made of a thin, plastic material. However, the lid 22 may be made of aluminum, a polymeric material, various blends of polymeric materials, among others. Further, the lid 22 may be made of sugar cane pulp, corn pulp, paper pulp, among others, and combinations thereof. The shape of the lid 22 may be any suitable shape that allows the lid 22 to removably attach to the housing first end 16. In the example shown in FIG. 2B, the lid 22 is the same shape as the cross-sectional shape of the housing 12. Further, the lid 22 may include an opening 28 providing access to the flexible storage bag 20. As shown in FIG. 2B, the opening 28 may be circular.

Figure 8:
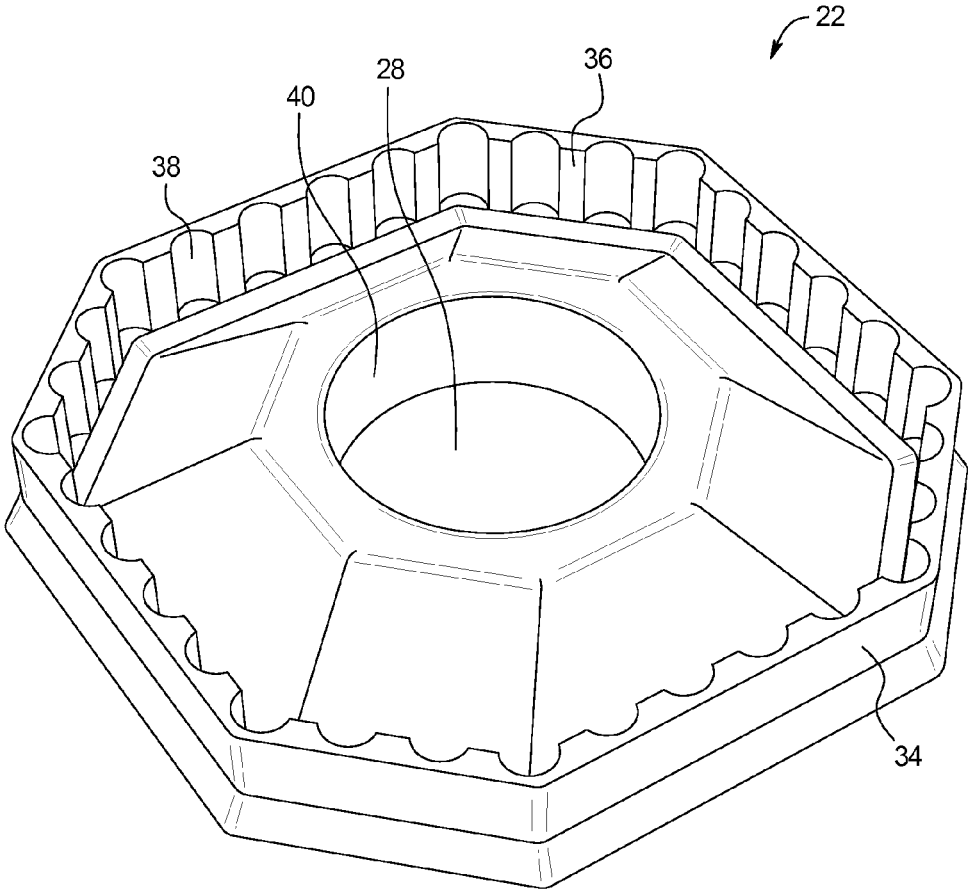
FIG. 8 is a perspective view of an embodiment of a lid.

The particular design of the lid 22 shown in FIG. 8 allows a very thin plastic to be used to form a strong and rigid lid 22. The lid 22 maintains the structural integrity of the container 10 by preventing the side walls 14 of the housing 12 from collapsing. The lid 22 may include an outer edging 34 and an inner edging 36. The outer edging 34 is typically flared outward slightly to allow the lid 22 to easily connect to the housing 12. The inner edging 36 may be flared as well. In addition, in some embodiments, the inner edging 36 may be scalloped-shaped (e.g., include a series of indentions 38) to both improve the grip of the lid 22 onto the housing 12, as well as to act as a spring to absorb any movement of the side walls 14 that may otherwise cause a dislodging of the lid 22 from the housing 12.

The opening 28 in the lid 22 may include a circular wall 40 that aids a user in puncturing the surface of the flexible storage bag 20 with a straw 30, without the straw 30 slipping on the flexible storage bag 20. Primarily, the circular wall 40 extends into the body of the housing 12 and makes contact along the top surface of the flexible storage bag 20. In doing so, the material at the top of the flexible storage bag 20 is held taught such that it is even easier to puncture with the straw 30. In addition, the circular wall 40 guides the straw 30, visually and physically, when the user is attempting to puncture the flexible storage bag 20.

In addition, the container 10 includes a shrink-wrap film 24 surrounding at least a portion of the housing 12 and at least a portion of the lid 22, wherein the shrink-wrap film 24 secures the lid 22 to the housing 12. The shrink-wrap film 24 essentially secures the lid 22 and flexible storage bag 20 to the housing 12 without the use of adhesives or other connecting mechanism, such as tape, glue, clips, or fasteners, among others. Because the container 10 does not use adhesives to secure various elements together, the container may be easily sorted into established recyclable products after the container is used. For example, once the shrink-wrap film 24 is removed, the lid 22, the flexible storage bag 20, and the housing 12 become unattached, thereby allowing the various elements to be easily sorted for recycling. For example, the shrink-wrap film 24, lid 22, and flexible storage bag 20 may be recycled in a plastic receptacle, whereas the housing 12 may be recycled in a paper receptacle, with minimal effort required to separate the various elements.

In addition, the shrink-wrap film 24 protects the housing 12 from moisture. This is particularly important when the housing 12 is made from a paper product that is susceptible to damage and/or weakness when exposed to moisture.

Figure 4:
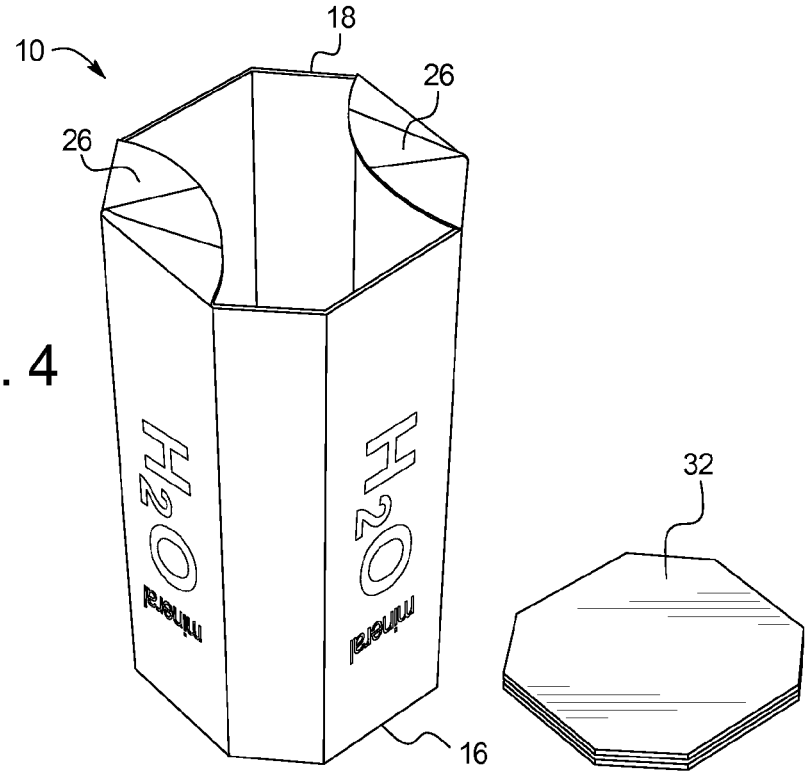
FIG. 4 is a bottom perspective view of the housing including tabs, wherein the bottom panel is leaning against the side wall of the housing.

As shown in FIG. 4, the container 10 may further include at least one tab 26 extending from the housing second end 18. Typically, the tab 26 is foldably connected to the housing second end 18. When folded into form for assembly, the at least one tab 26 defines a bottom plane perpendicular to the side wall 14. The tab 26 may be made of the same or different material as the housing 12. Further, the shape of the tab 26 may be any suitable shape. For example, the tab 26 may be formed by overlapping at least two tabs 26.

Figure 5:
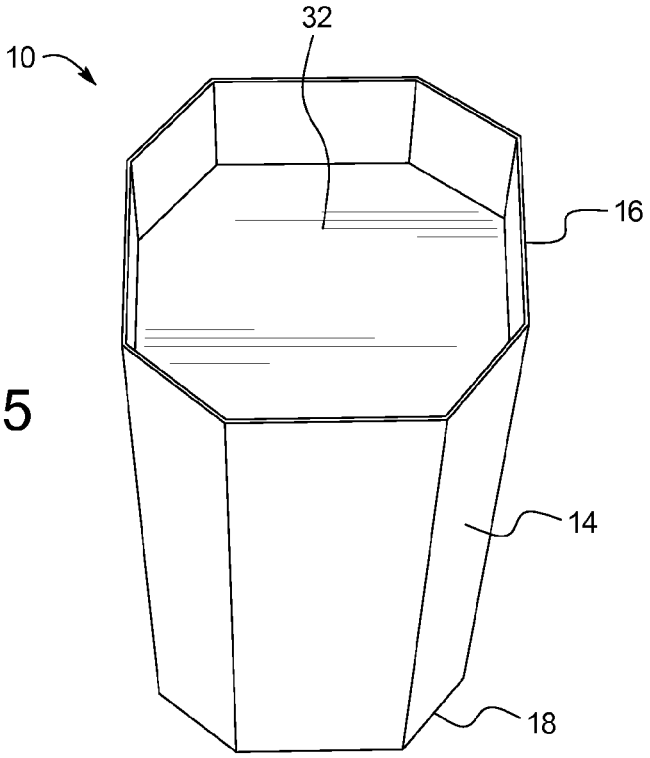
FIG. 5 is a top perspective view of the bottom panel being pushed through the housing toward the bottom plane.

As shown in FIG. 5, the container may include a bottom panel 32 that may be inserted from the housing first end 16 to the housing second end 18. The bottom panel 32 may be made as the same or different material as the housing 12. In one example, the bottom panel 32 is made of corrugated cardboard in order help provide structural integrity to the housing 12 side walls 14 from the inside of the container 10.

For example, the bottom panel 32 may be made from a relatively thick (e.g., 5 mm) corrugated cardboard, which adds rigidity to the base assembled container 10. Without a strengthened bottom panel 32, the container 10 may be unable to hold up to rigorous use required in distribution, stocking, sale, and end use. A strengthened bottom panel 32 can increase the pressure resistance of the container 10 by adequately supporting the side walls 14 from the inside of the housing 12.

Figure 6:
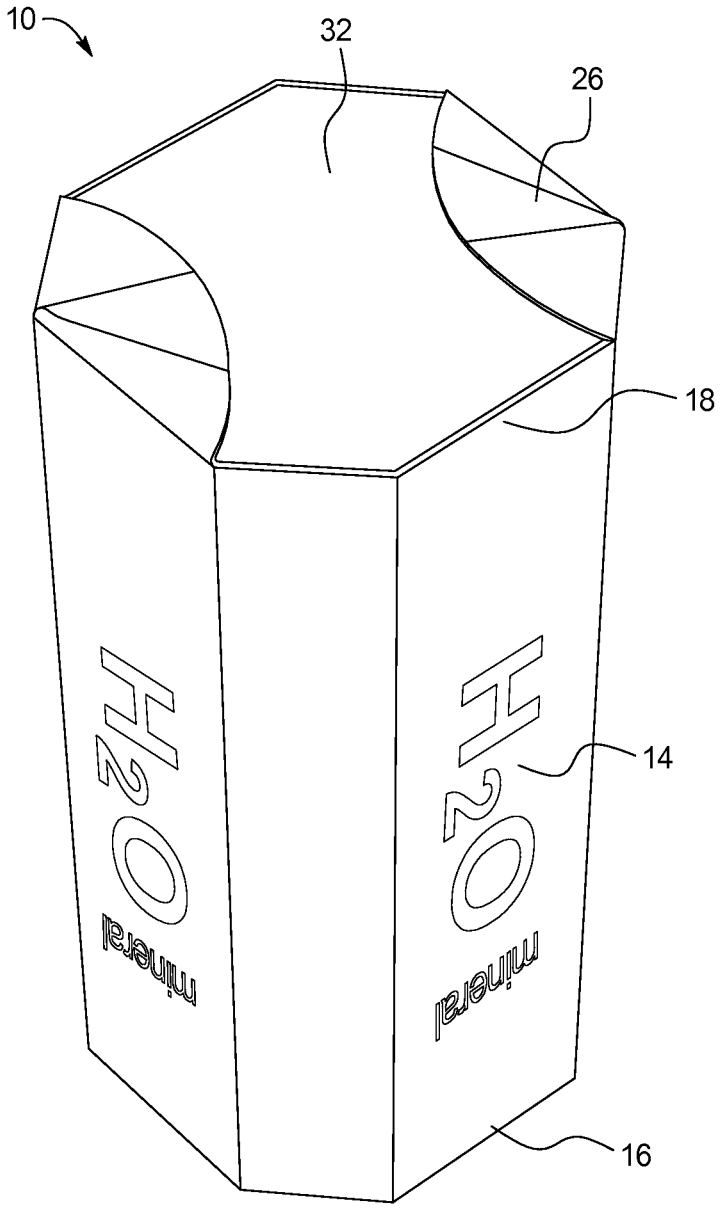
FIG. 6 is a bottom perspective view of the housing including tabs, wherein the bottom panel is in contact with the tabs in the bottom plane.

As shown in FIG. 6, the bottom panel 32 may be located along or adjacent to the bottom plane perpendicular to the side wall 14 that is defined by the at least one tab 26. In assembled form, the at least one tab 26 may stabilize the bottom panel 32 within the housing 12. Further, the shrink-wrap film 24 may surround at least a portion of the at least one tab 26, wherein the combination of the tab 26 and the shrink-wrap film 24 cooperate to retain the bottom panel 32 within the housing 12 along the bottom plane. In other words, the shrink-wrap film 24 and at least one tab 26 secures the bottom panel 32 such that minimal or no adhesive is required for the structural integrity of the container 10. Again, the lack of adhesive or other fasteners between the housing 12 and the lid 22 and between the bottom panel 32 and tab 26 results in an environmentally friendly container 10, the components of which are easily separable for recycling purposes. In addition, the bottom panel 32 does not require the use of expensive folding equipment as most conventional boxes and containers require.

As described, the interaction between the bottom panel 32, the tab 26 (or tabs 26), and the shrink-wrap film 24 creates a stable container 10 using multiple parts without the use of adhesives; the bottom panel 32 providing the structural support for the side walls 14 and the shrink-wrap film 24 cooperating with the tab 26 (or tabs 26) to locate and retain the bottom panel 32 in place. It is contemplated that this unique structure may form the basis of many variations of containers, whether or not paired with the other elements of the container 10 described herein. For example, it is contemplated that in some embodiments of the container 10 presented herein, the structural integrity of the container 10 does not rely on the shrink-wrap film 24, but rather is fully provided by the configuration of the housing 12, the bottom panel 32, one or more tabs 26, and the lid 22 alone, without a shrink-wrap film 24. In another example, an embodiment of the container 10 may include a housing 12, with a bottom panel 32 held on place by one or more tabs 26 without a shrink-wrap film 24. Such embodiments may be aided in maintaining their structure by the contents of the container 10, which may help secure a stable fit between the housing 12 and the bottom panel 32.

The container 10 may also include a straw 30 releasably connected to an outer surface of the shrink-wrap film 24, wherein the straw 30 is configured to puncture through the shrink-wrap film 24, proceed through the opening 28 in the lid 22, and puncture the flexible storage bag 20. The straw 30 may be encased in a thin film that may be removed from the shrink-wrap film 24. The length of the straw 30 may be expandable in order to access the entirety of the flexible storage bag 20 once the straw 30 has been inserted.

The present disclosure also provides a method of forming a container 10, wherein the method comprises forming a housing 12 including a side wall 14, a housing first end 16, and a housing second end 18. The housing 12 may be formed by folding, either by hand or part of an automated assembly line process, a single sheet of material, such as paper, into a three-dimensional structure.

The method further includes inserting a flexible storage bag 20 into the housing 12. The flexible storage bag 20 may store a liquid. Alternatively, the flexible storage bag 20 may be inserted into the housing 12 empty and subsequently filled with a liquid and sealed.

The method also includes placing a lid 22 over the housing first end 16, wherein the lid 22 secures at least a portion of the flexible storage bag 20 between the housing first end 16 and the lid 22. In addition, the lid 22 is secured to the housing 12 by heat-sealing a shrink-wrap film 24 around at least a portion of the housing 12 and at least a portion of the lid 22.

The method may further include releasably attaching a straw 30 to an outer surface of the heat sealed shrink-wrap film 24, wherein the straw 30 is configured to puncture through the shrink-wrap film 24 and the flexible storage bag 20.

Figure 7A:
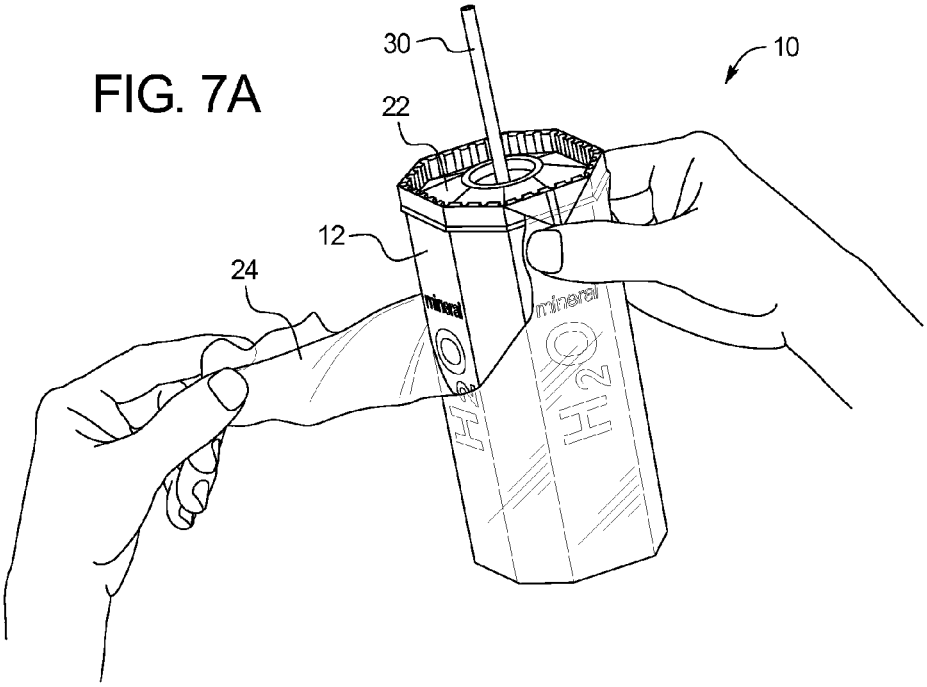
FIG. 7A-7D is an illustration of the disassembly of the container into separate recyclable parts.
Figure 7B:
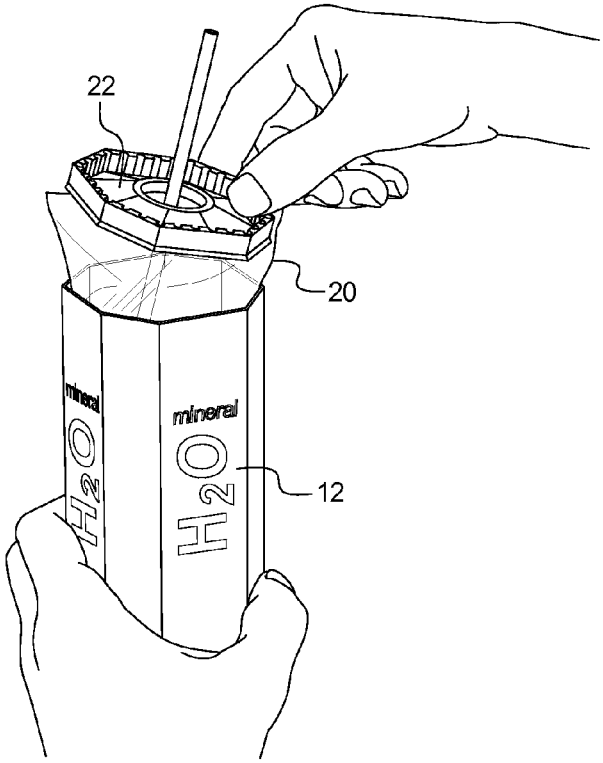
Figure 7C:
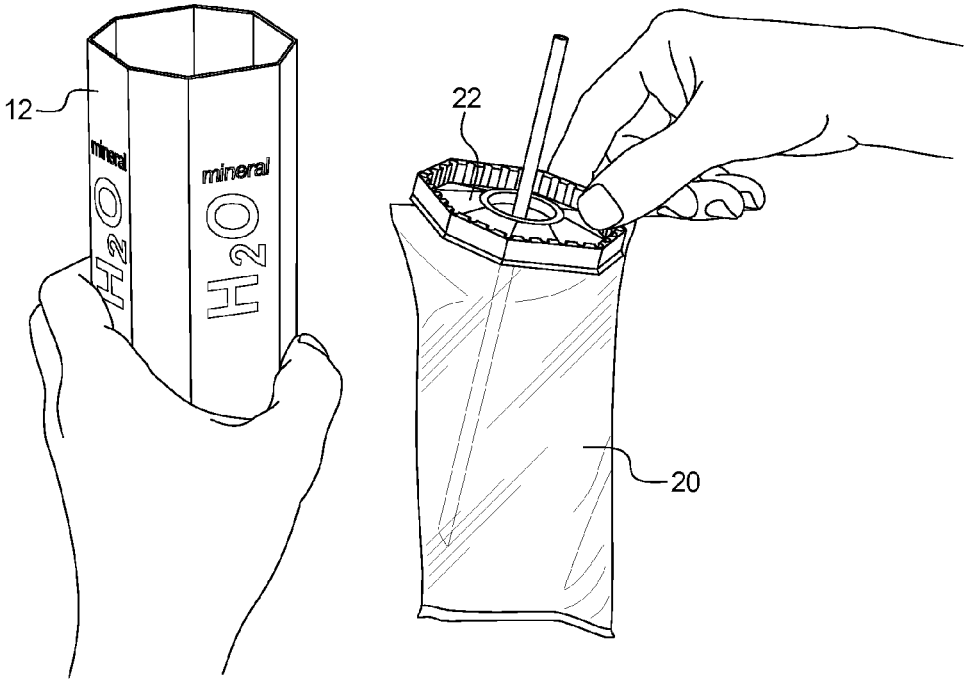
Figure 7D:
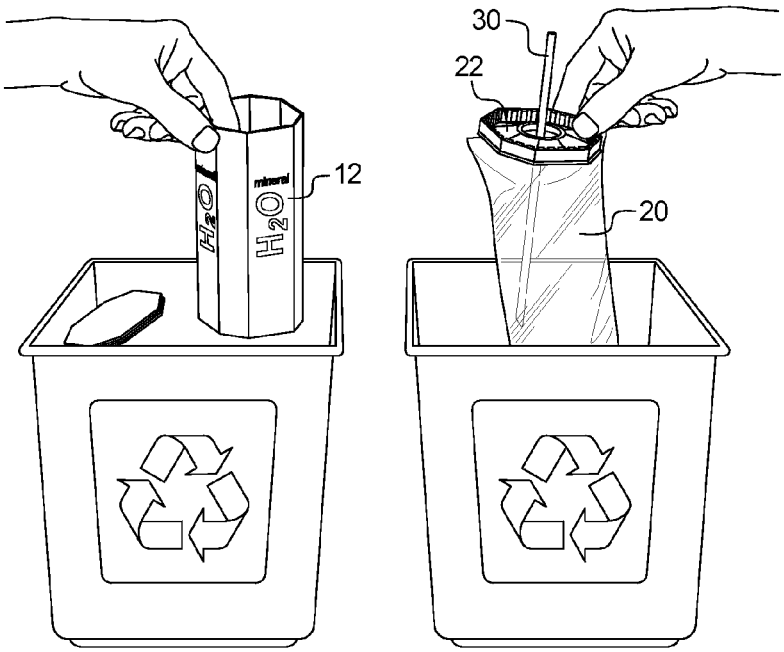

As illustrated by FIGS. 7A-7D, the container 10 disclosed herein is easily disassembled into separate elements for recycling. As shown in FIG. 7A, the shrink-wrap film 24 may be separated from the housing 12. FIG. 7B illustrates that the straw 30, the lid 22, and the flexible storage bag 20 are easily separated from the housing 12. FIGS. 7C-7D illustrate the separation of the straw 30, the lid 22, and the flexible storage bag 20 from the housing 12, for recyclable purposes. Because the container 10 does not use adhesive or other permanent fastening mechanisms between the shrink-wrap film 24, the housing 12, the lid 22, and the flexible storage bag 20, the components are easily separated into recyclable elements without complication or substantial effort.

It should be noted that various changes and modifications to the embodiments described herein will be apparent to those skilled in the art. Such changes and modifications may be made without departing from the spirit and scope of the present invention and without diminishing its attendant advantages. For example, various embodiments of the method and portable electronic device may be provided based on various combinations of the features and functions from the subject matter provided herein.

We claim:

1. A container comprising:

a housing including opposing side walls, a housing first end, and a housing second end;

a flexible storage bag within the housing;

a lid positioned over the housing first end, wherein first and second portions of the flexible storage bag extend from inside the housing over the opposing sidewalls and are secured between the lid and the housing first end;

a shrink-wrap film surrounding at least a portion of the housing and at least a portion of the lid, wherein the shrink-wrap film secures the lid to the housing;

a bottom panel; and at least one tab extending from the housing second end;

wherein the shrink-wrap film surrounds at least a portion of the at least one tab, wherein the at least one tab and the shrink-wrap film cooperate to retain the bottom panel within the housing.

2. The container of claim 1 wherein the at least one tab defines a bottom plane perpendicular to the side wall, wherein the at least one tab and the shrink-wrap film retain the bottom panel within the housing along the bottom plane.

3. The container of claim 1 wherein the housing is formed from a single sheet of paper.

4. The container of claim 1 wherein at least two portions of the flexible storage bag are secured between the lid and the housing first end.

5. The container of claim 1 wherein the lid includes an opening providing access to the flexible storage bag.

6. The container of claim 1 further comprising a straw releasably connected to an outer surface of the shrink-wrap film, wherein the straw is configured to puncture through the shrink-wrap film and the flexible storage bag.

7. The container of claim 1 further comprising a liquid within the flexible storage bag, wherein the amount of liquid is less than the storage capacity of the flexible storage bag.

8. The container of claim 1 wherein the housing is made of a foldable cardboard.

9. The container of claim 1 wherein the flexible storage bag is made of a polymeric material.

10. The container of claim 1 wherein the cross-sectional shape of the housing is an octagon.

11. The container of claim 1 wherein shrink-wrap alone secures the lid to the housing.

* * * * *